US008692722B2

(12) United States Patent
Brink

(10) Patent No.: US 8,692,722 B2
(45) Date of Patent: Apr. 8, 2014

(54) WIRELESS FIELD DEVICE OR WIRELESS FIELD DEVICE ADAPTER WITH REMOVABLE ANTENNA MODULE

(75) Inventor: Christopher Michael Brink, Harrisburg, PA (US)

(73) Assignee: Phoenix Contact Development and Manufacturing, Inc., Middletown, PA (US)

( * ) Notice: Subject to any disclaimer, the term of this patent is extended or adjusted under 35 U.S.C. 154(b) by 581 days.

(21) Appl. No.: 13/018,572

(22) Filed: Feb. 1, 2011

(65) Prior Publication Data

US 2012/0194405 A1 Aug. 2, 2012

(51) Int. Cl.
*H01Q 1/24* (2006.01)

(52) U.S. Cl.
USPC ..... 343/702; 343/906; 343/872

(58) Field of Classification Search
USPC ..... 343/702, 906, 872
See application file for complete search history.

(56) References Cited

U.S. PATENT DOCUMENTS

| | | | | |
|---|---|---|---|---|
| 3,838,645 | A | 10/1974 | Finger et al. | |
| 5,273,815 | A | 12/1993 | Brydon et al. | |
| 6,326,925 | B1 | 12/2001 | Perkiöet al. | |
| 7,017,256 | B2 | 3/2006 | Joly et al. | |
| 7,038,636 | B2 | 5/2006 | Larouche et al. | |
| 7,057,577 | B1 | 6/2006 | Willoughby et al. | |
| 7,230,572 | B2 | 6/2007 | Aisenbrey | |
| 7,777,997 | B2 | 8/2010 | Goidas et al. | |
| 7,852,271 | B2 | 12/2010 | Grunig et al. | |
| 2002/0075188 | A1* | 6/2002 | Wu | 343/702 |
| 2004/0183744 | A1 | 9/2004 | Raiman | |
| 2004/0194994 | A1 | 10/2004 | Rasmussen | |
| 2005/0024291 | A1 | 2/2005 | Aisenbrey | |
| 2006/0071873 | A1 | 4/2006 | Warnagiris | |
| 2007/0267747 | A1 | 11/2007 | Wessling | |
| 2008/0265215 | A1 | 10/2008 | Wessling | |
| 2009/0033573 | A1 | 2/2009 | Capece et al. | |
| 2009/0081963 | A1 | 3/2009 | Boren | |
| 2009/0264583 | A1 | 10/2009 | Kurz et al. | |
| 2010/0003438 | A1 | 1/2010 | Bryant et al. | |
| 2010/0043971 | A1 | 2/2010 | Long et al. | |
| 2010/0090883 | A1 | 4/2010 | Chen et al. | |
| 2010/0259461 | A1 | 10/2010 | Eisenbeis et al. | |
| 2012/0075161 | A1* | 3/2012 | Elwell et al. | 343/872 |

FOREIGN PATENT DOCUMENTS

| | | | |
|---|---|---|---|
| DE | 19506175 | B4 | 10/2004 |
| DE | 1318565 | B1 | 3/2006 |
| DE | 102005010162 | B4 | 6/2007 |
| DE | 102006030965 | A1 | 1/2008 |
| DE | 102008018968 | A1 | 10/2009 |
| DE | 102009023150 | A1 | 12/2010 |
| DE | 102009027244 | A1 | 12/2010 |
| DE | 102004003784 | B4 | 1/2011 |

(Continued)

*Primary Examiner* — Hoanganh Le
(74) *Attorney, Agent, or Firm* — Hooker & Habib, P.C.

(57) ABSTRACT

A wireless field device or an adapter for converting a wired field device to a wireless field device includes a housing, a first connector on the housing, and a removable antenna module that includes an antenna, a second connector coupleable and uncoupleable with the first connector, and a radome that houses the antenna and fits on the second connector. The radome is made of a static dissipative material that dissipates static buildup without sparking when coupling or uncoupling the connectors, enabling the antenna to be removed or replaced while the field wireless field device is located in a hazardous (classified) location.

19 Claims, 5 Drawing Sheets

(56) References Cited

FOREIGN PATENT DOCUMENTS

| | | | |
|---|---|---|---|
| EP | 0551710 | A1 | 7/1993 |
| EP | 0982794 | A2 | 3/2000 |
| EP | 0780847 | B1 | 5/2001 |
| EP | 1117148 | A2 | 7/2001 |
| EP | 1192684 | B1 | 8/2004 |
| EP | 1463146 | A1 | 9/2004 |
| EP | 1122811 | B1 | 11/2004 |
| EP | 1519442 | A1 | 3/2005 |
| EP | 1810367 | B1 | 8/2007 |
| EP | 0997970 | A1 | 12/2007 |
| EP | 2120283 | A1 | 11/2009 |
| GB | 2286927 | A | 8/1995 |
| JP | 10134986 | | 5/1998 |
| JP | 200605473 | | 2/2006 |
| KR | 1020050066223 | | 6/2005 |
| WO | 2007000142 | A2 | 1/2007 |
| WO | 2007087964 | A1 | 8/2007 |

* cited by examiner

WIRELESS FIELD DEVICE OR WIRELESS FIELD DEVICE ADAPTER WITH REMOVABLE ANTENNA MODULE

FIELD OF THE DISCLOSURE

The disclosure relates to field devices used in the process control and measurement industry, and particularly to field devices that utilize wireless data transmission.

BACKGROUND OF THE DISCLOSURE

Field devices are used in the process control and measurement industry to monitor and automatically control industrial and chemical processes. A field device transmits data representing a physical parameter such as temperature, pressure, position, or the like to a process control computer or host, and may also receive control signals that require the field device to take an action such as opening or closing a valve.

Field devices may be located in hazardous (classified) locations that can be a flammable or explosive environment. Field devices located in a flammable or explosive environment may be designed with intrinsic safety as a protection type. That is, the energy utilized by the device is low and incapable of causing a spark that may trigger an explosion or fire.

Field devices originally transmitted data to and from the host through a wired network. The wired network may also deliver power to the field devices. The power delivered by the wired network itself may be limited to an intrinsically-safe level when delivering power to field devices located in a hazardous (classified) location.

Wireless data transmission, however, is becoming popular. Wireless field devices include an antenna that sends and receives the wireless data. The antenna is housed in a radome conventionally made of an electrical insulator that separates the antenna from the ambient environment.

Wireless field devices may be designed from the start for wireless data transmission only, or may be converted from wired field devices utilizing a wireless network adapter that adds wireless capability to the wired field device.

Wireless field devices can be arranged in networks, such as mesh or star networks, which enable the use of relatively low power radio signals to and from the wireless field devices. Such low power wireless field devices are advantageous for use in hazardous (classified) locations.

Wireless field devices for use in hazardous (classified) locations typically utilize capacitors or other circuit elements in the antenna signal path. These circuit elements act as a high-pass filter that, in the event the antenna is shorted out, allows only a low-energy pulse to be generated and passed to the antenna. The low-energy pulse cannot trigger a spark.

A conventional wireless field device has a permanently fixed antenna. The antenna is not to be removed once the wireless field device is placed in the hazardous (classified) location.

It is desirable to have wireless field device that includes a replaceable or removable antenna, and particularly a wireless field device for use in a hazardous (classified) location that includes a replaceable or removable antenna. Such a wireless field device could have a defective or poorly performing antenna replaced in the field, even if the wireless field device were located in a hazardous (classified) location.

A concern of wireless field devices in a hazardous (classified) location is static electricity. Removing or attaching the antenna may itself generate a spark that jumps between the antenna radome (an insulator) and the device housing due to the accumulation of static electricity.

Thus there is a need for an improved wireless field device for use in a hazardous (classified) location with a removable antenna that resists sparking when removing or replacing the antenna.

BRIEF SUMMARY OF THE DISCLOSURE

Disclosed is an improved wireless field device (or an adapter for converting a wired field device to a wireless field device) for use in a hazardous (classified) location that includes a removable antenna that resists sparking when removing or replacing the antenna.

A disclosed embodiment of a wireless field device or adaptor includes a housing, a wireless communications module in the housing, a first connector half on the housing, the first connector half capable of transmitting a radio-frequency signal, a first signal line in the housing extending from the first connector line to the wireless communications module, an antenna module removably attachable to the first connector half, and a body comprising static dissipative material.

The antenna module includes a second connector half, an antenna electrically connected to the second connector half, and a radome, the antenna in the radome.

The second connector half is coupleable and uncoupleable with the first connector half, the first and second connector halves capable of communicating radio-frequency signals therebetween when coupled together. The body is in electrical contact with the first connector half when the antenna module is attached to the first connector half.

A static dissipative material is an electrostatic discharge (ESD) protective material having a surface resistivity greater than $10^5$ (10 raised to the power of 5) ohms per square but not greater than $10^9$ (10 raised to the power of 9) ohms per square. Surface resistivity of a material is numerically equal to the surface resistance between two electrodes forming opposite sides of a square. The size of the square is immaterial. Surface resistivity applies to both surface and volume conductive materials and has the value of ohms per square.

Built-up static charge between the antenna module and the remainder of the field device or adapter is dissipated to ground through the static dissipative body, resisting sparking when coupling or uncoupling the connector halves.

In a preferred embodiment, the radome is the static dissipative body. The radome is preferably made from a statically dissipative thermoplastic. An interference fit between the radome and the second connector half mechanically attaches and electrically connects the radome with the second connector half.

Other objects and features will become apparent as the description proceeds, especially when taken in conjunction with the accompanying five drawing sheets.

DESCRIPTION OF THE PREFERRED EMBODIMENT

Figure 1:
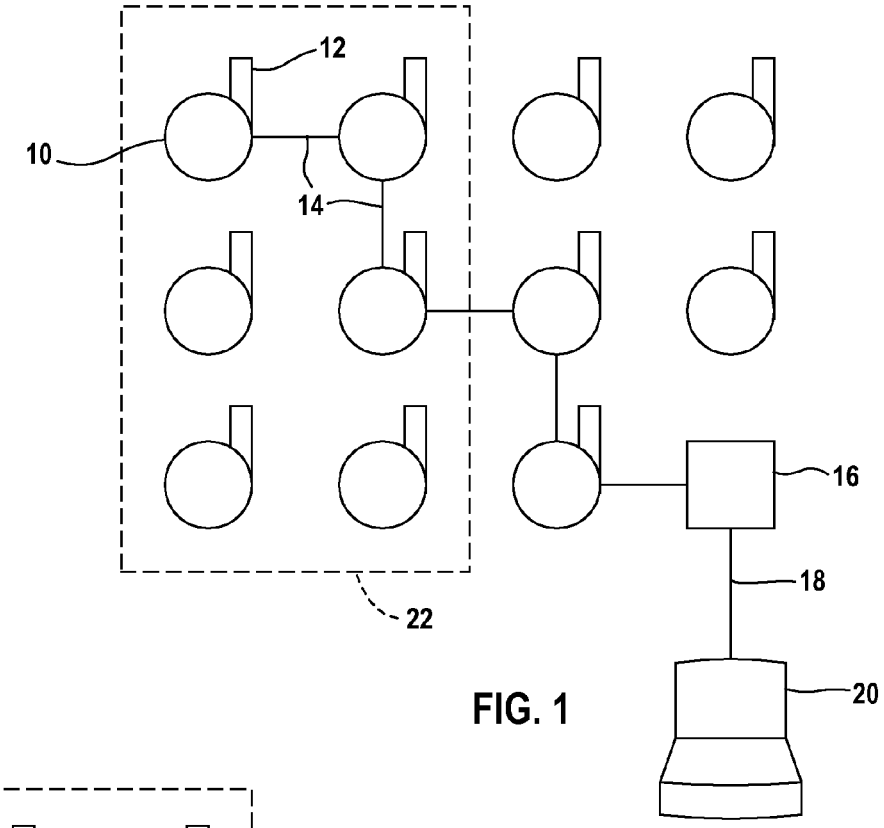
FIG. 1 illustrates field devices forming a wireless mesh network.

FIG. 1 illustrates a number of wireless field devices 10 forming a self-organizing mesh network as is known in the distributed control system art. Each field device 10 forms a node on the network and includes a removable antenna assembly or module 12 that enables a field device 10 to receive or transmit radio frequency communications 14 through adjacent nodes to a gateway device 16. The gateway device 16 is conventional and connects the mesh network through a wired network connection 18 to a host 20.

Some of the wireless field devices 10 are located in a hazardous (classified) location represented by the dashed rectangle 22. The hazardous (classified) location can be a flammable or explosive environment. As described in greater detail below, the antenna module 12 of a field device 10 resists sparking and can be removed and replaced in the field even if the field device 10 is located in the hazardous (classified) location 22.

Figure 2:
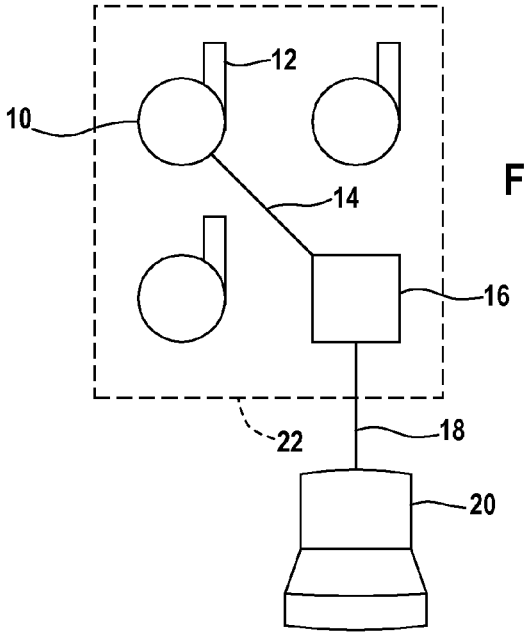
FIG. 2 illustrates field devices forming a wireless star network.

FIG. 2 illustrates the wireless field devices 10 forming a star network as is known in the distributed control system art. Each field device 10 forms a node on the network that receives or transmits radio frequency communications 14 directly with the gateway device 16. The gateway device connects the star network through the wired connection 18 to the host 20. The field devices 10 are located in the hazardous (classified) location 22, and the antenna module 12 of a field device 10 can be removed or replaced while the field device 10 remains in the hazardous (classified) location 22. A star network can be combined with one or more other star networks to form a hybrid mesh network (not shown) as is also known in the distributed control system art.

Figure 3:
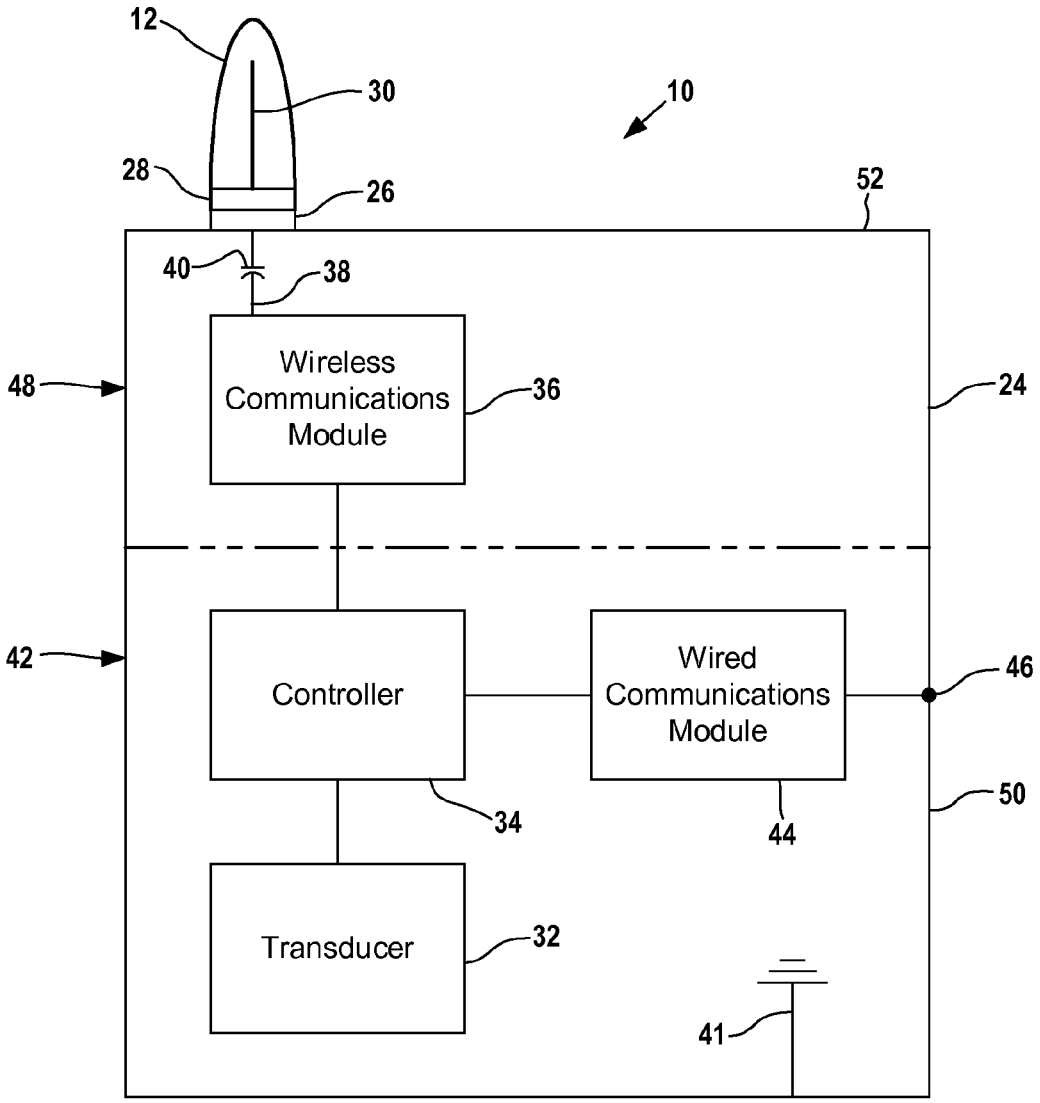
FIG. 3 is a schematic block diagram of a wireless field device.

FIG. 3 schematically illustrates a wireless field device 10, it being understood that field devices 10 may be manufactured in many different shapes and sizes.

The field device 10 includes a housing 24 that may be an explosion-proof housing or other suitable housing designed for use in a hazardous (classified) location. Attached to the outer surface of the housing is a first connector half 26. The antenna module 12 includes a mating second connector half 28 coupleable with the first connector half 26 to removably mount the antenna module 12 on the housing 10, and an antenna 30 that receives and transmits radio signals.

The housing 24 encloses a transducer 32 that communicates process control signals representing physical data or control data with a controller 34. The controller 34 in turn communicates with a wireless communications module 36 operatively connected to the first connector half 26 through a signal line 38. The wireless communications module 36 converts radio frequency signals to control signals and vice versa to enable wireless communication signal 14 transmission of data to and from the controller 34. The signal line 38 may include capacitance represented by the capacitor 40 or other circuit elements (not shown) as is known in the art that limits or controls the energy in the signal line 38 in the event of a short circuit to resist sparking or arcing. The circuitry is grounded at an internal ground 41.

The illustrated wireless field device 10 was originally a HART-enabled wired field device 42 that included the transducer 32 and the controller 34, and included a wired communications module 44 and a junction 46 for connection to a wired network. A wireless network adapter 48 mechanically attaches to the housing 50 of the field device 42 and converts the wired field device 42 to the wireless HART enabled field device 10. The network adapter 48 includes its own housing 52 designed for a hazardous (classified) location, that is, the illustrated housing 24 is formed from the wired field device housing 50 and the network adapter housing 52. The first connector half 26 is fixed to the outside of the adapter housing 52, and the wireless network adapter 48 also includes the wireless communications module 36 and the signal line 38. The antenna module 12 is provided with the wireless network adapter 48. The antenna sends and transmits data over the 2.4 GHz band as specified in the wireless HART standard.

Figure 4:
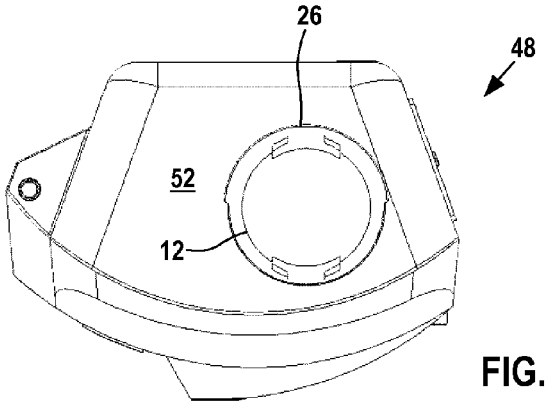
FIGS. 4, 5, and 6 are top, front, and side views of the network adapter forming a part of the wireless field device shown in FIG. 3.
Figure 5:
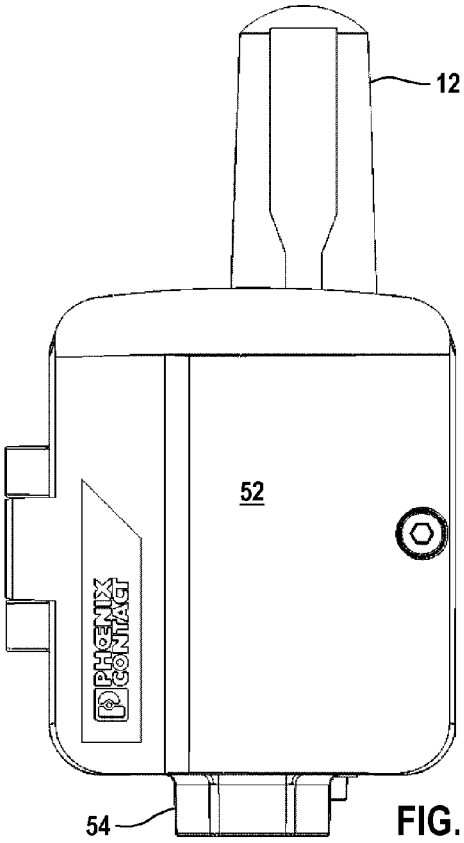
Figure 6:
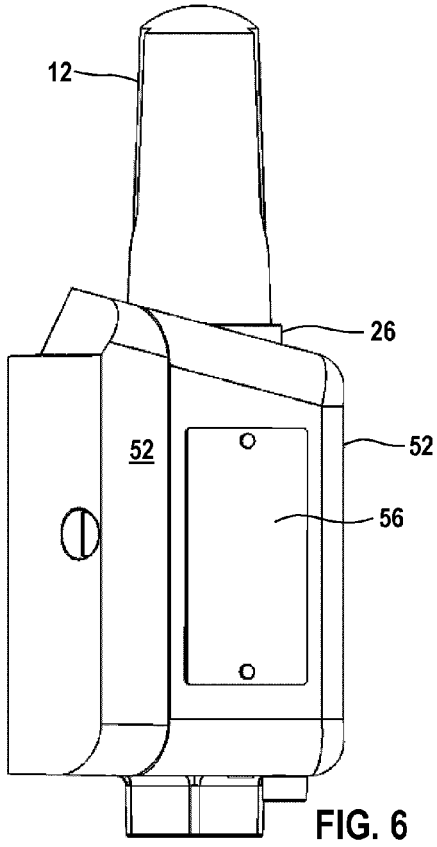

FIGS. 4-6 illustrate the wireless network adapter 48 with the antenna module 12 attached. The network adapter 48 includes mounting structure 54 on one, lower, end of the adapter for attaching the adapter to a wired field device, and a removable access cover 56 that enables access to the internal wiring and wiring connections. In this embodiment the first connector half 26 is a conventional, metal female bulkhead N-type connector fastened to the opposite, upper, end of the adapter 48.

Figure 7:
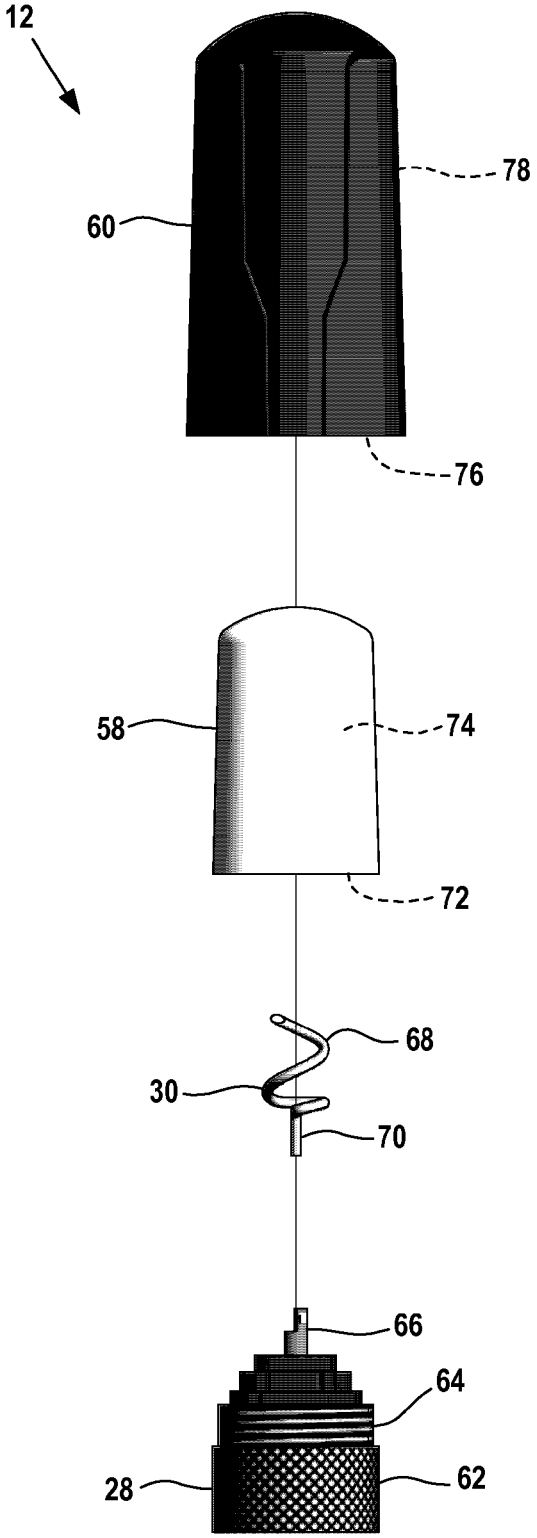
FIG. 7 is an exploded view of the replaceable antenna module forming part of the network adapter shown in FIGS. 4-6.

FIG. 7 is an exploded view of the antenna module 12. The module 12 includes the second fastener half 28, a helical antenna 30, a cap 58, and a radome 60.

The second connector half 28 is a metal, male N-type connector. An enlarged diameter connector portion 62 is located on one end of the connector 28 adjacent an externally threaded, reduced-diameter cylindrical body portion 64. A tubular ferrule 66 is located on the other end of the body 28 and extends through the body 28.

The antenna 30 has a helical portion 68 and an elongate post 70 that attaches the antenna 30 within the ferrule 66.

The cap 58 is a one-piece integral member that has a bottom opening 72 and defines an interior volume 74. The cap 58 is made of a non-conductive, radio-signal transparent plastic as is known in the art.

The radome 60 is a one-piece, integral member that has a bottom opening 76 and defines an interior volume 78.

The radome 60 is made entirely of a static dissipative material.

The radome 60 is preferably an injected-molded member molded from a high flow thermoplastic that is inherently dissipative in composition. Preferably the thermoplastic includes no embedded metallic conductors or fibers that would degrade antenna performance. The compound is formulated to meet the static dissipative requirements of the ATEX Directive for equipment intended for use in the EU in potentially explosive atmospheres. Such a material is available from RTP Company, 580 East Front Street, Winona, Minn. 55987 and other suppliers. Other static dissipative materials are known and can be used if the material has sufficient transparency to radio signals.

Figure 8:
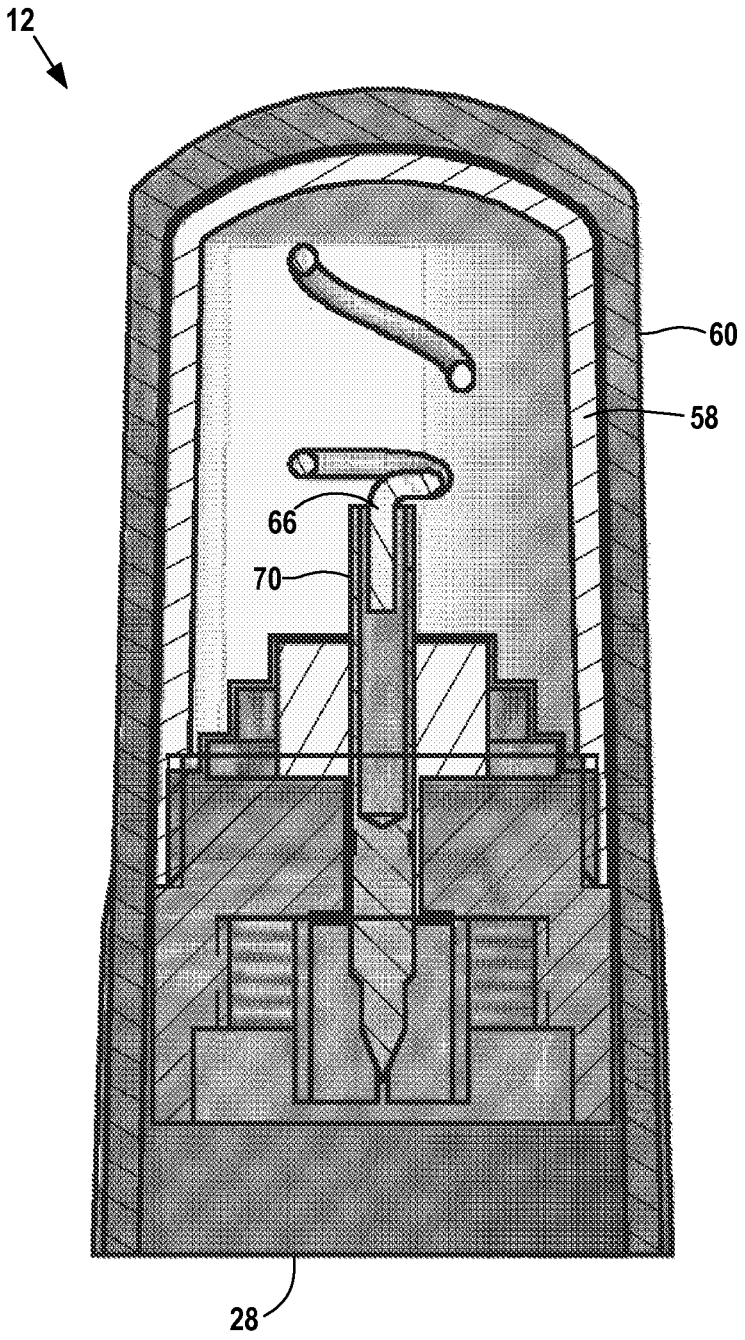
FIG. 8 is a vertical sectional view of the replaceable antenna module shown in FIG. 7.

FIG. 8 is a sectional view of the antenna module 12. The antenna post 70 is inserted into the connector ferrule 66 and soldered in place, rigidly fixing the antenna to the connector ferrule 66. The plastic cap 58 threads onto the connector body portion 64. The connector body portion 64 closes the open end 72 of the cap 58 with the antenna 30 housed inside the cap interior 74. The assembled cap 58 and connector 28 are then inserted through the radome opening 76 into the radome 60, the cap 58 and antenna 30 in the interior 78 of the radome 60. The connector 28 closes the radome opening 76, with the inner surface of the radome 30 and the outer surface of the enlarged connector body portion 66 defining and forming an interference fit that simultaneously mechanically attaches the radome 30 to the connector 28 and electrically connects the radome 30 and the connector 28.

During normal use of the field device 10, the antenna 30 receives and transmits radio signals in a conventional manner through the radome 60. The illustrated antenna 30 receives and transmits radio signals on the 2.4 GHz bandwith in compliance with the wireless HART standard.

When it is desired to remove or replace the antenna 30, the antenna module 12 is removed from or attached to the field device by uncoupling or re-coupling the connector halves 26, 28. Built-up static charge between the wireless module 12 and the remainder of the field device 10 is dissipated to ground through the static dissipative material forming the radome 60 that is electrically in contact with the connector half 28.

The illustrated connector halves 26, 28 form a standard N-type connector capable of transmitting radio frequency signals. In other embodiments the first and second connector halves can be in the group off: (a) BNC-type connector; (b) BMA-type connector; (c) SMP-type connector; (d) SMA-type connector; (e) another known connector type capable of transmitting radio frequency signals; or (f) a future developed connector.

Along with the HART data and wireless data transmission protocol, data protocols that can be adapted for use with the disclosed field device include without limitation the FOUNDATION Fieldbus, Profibus, Modbus, ZIGBEE, and ISA 100.11a protocols as standardized in the process control and measurement industry (as well as future-developed data protocols). Wireless data transport can also be accomplished using cell phone protocols, wireless LAN or wifi protocols, wireless ethernet, Bluetooth, or other known or future-developed wireless data transport protocols.

While I have illustrated and described an embodiment of a field device, I do not wish to be limited to the precise details set forth, but desire to avail myself of such changes and alterations as fall within the purview of the following claims.

What I claim as my invention is:

1. A replaceable antenna module for attachment to a conforming base of a field device located in a hazardous (classified) location, the conforming base capable of conducting radio-frequency signals, said antenna module comprising:

a base made at least partially of a conductive material capable of conducting radio-frequency signals, said base configured for mating with said conforming base to conduct radio-frequency signals therebetween;

an antenna coupled to the base to send and receive radio frequency signals;

a radome attached to the base, the radome defining an opening and an interior volume, the antenna in the interior volume of the radome, the base closing the radome opening; and a statically dissipative material coupled to the base and in electrical contact with the base.

2. The replaceable antenna module of claim 1 wherein the radome comprises a surface in electrical contact with the conductive material of the base, said statically dissipative material forming said radome surface.

3. The replaceable antenna module of claim 2 wherein the radome is a one-piece, integral member formed from said statically dissipative material.

4. The replaceable antenna module of claim 3 wherein the radome comprises an inner surface and the conductive material defines an outer surface of the base, the inner and outer surfaces cooperatively forming an interference fit therebetween.

5. The replaceable antenna module of claim 4 comprising a rigid cap mounted on the base;

the cap defining an interior volume of the cap;

the antenna in the interior volume of the cap.

6. The replaceable antenna module of claim 5 wherein the base is an N-type connector.

7. The replaceable antenna module of claim 1 wherein said statically dissipative material has a surface resistance greater than 10 raised to the power of 5 but less than 10 raised to the power of 9 ohms per square.

8. The replaceable antenna module of claim 1 wherein said statically dissipative material is a conductive polymer material.

9. The replaceable antenna module of claim 1 wherein said base is in the group of: (a) BNC-type connector; (b) BMA-type connector; (c) SMP-type connector; (d) SMA-type connector; and (e) N-type connector.

10. A wireless field device or an adaptor for converting a wired field device to a wireless field device, the field device or adapter comprising:

a housing, a wireless communications module in the housing, a first connector half on the housing, the first connector half capable of transmitting a radio-frequency signal, a first signal line in the housing extending from the first connector half to the wireless communications module, an antenna module removably attachable to the first connector half, and a body comprising static dissipative material;

the antenna module comprising a second connector half, an antenna electrically connected to the second connector half, and a radome, the antenna in the radome;

the second connector half coupleable and uncoupleable with the first connector half, the first and second connector halves capable of communicating radio-frequency signals therebetween when coupled together; and the body in electrical contact with the first connector half when the antenna module is attached to the first connector half.

11. The device or adapter of claim 10 wherein the body is the radome.

12. The device or adapter of claim 11 wherein the radome is a one-piece, integral member.

13. The device or adapter of claim 12 wherein the radome comprises thermoplastic.

14. The device or adapter of claim 12 wherein the second connector half comprises an electrically-conductive outer surface and the radome comprises an inner surface, the inner and outer surfaces forming an interference fit.

15. The device or adaptor of claim 11 wherein the radome has an opening and the base closes the opening.

16. The device or adaptor of claim 10 wherein the first and second connector halves is in the group of:

(a) BNC-type connector; (b) BMA-type connector; (c) SMP-type connector; (d) SMA-type connector; and (e) N-type connector.

17. The device or adapter of claim 10 wherein the antenna module comprises a cap made of an electrical insulator attached to the base, the antenna in the cap.

18. The device or adapter of claim 10 wherein the wireless communications module implements a wireless data transport protocol in the group of: (a) wireless HART, (b) wireless FIELDBUS, (c) ZIGBEE, (d) BLUETOOTH, (e) WIFI , and (f) ISA 100.11a.

19. The device or adapter of claim 10 wherein the antenna is rigidly connected to the second connector half.

* * * * *